US007950832B2

(12) United States Patent
Tanaka et al.

(10) Patent No.: US 7,950,832 B2
(45) Date of Patent: May 31, 2011

(54) LED LUMINAIRE

(75) Inventors: Kenichiro Tanaka, Neyagawa (JP); Yutaka Iwahori, Ibaraki (JP); Yuji Suzuki, Hirakata (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 350 days.

(21) Appl. No.: 12/279,680

(22) PCT Filed: Feb. 22, 2007

(86) PCT No.: PCT/JP2007/053320

§ 371 (c)(1),
(2), (4) Date: Aug. 15, 2008

(87) PCT Pub. No.: WO2007/099860

PCT Pub. Date: Sep. 7, 2007

(65) Prior Publication Data

US 2010/0219760 A1 Sep. 2, 2010

(30) Foreign Application Priority Data

Feb. 23, 2006 (JP) ..... 2006-047494
Feb. 23, 2006 (JP) ..... 2006-047496

(51) Int. Cl.
*F21V 33/00* (2006.01)

(52) U.S. Cl. ..... 362/311.02; 362/800; 362/803

(58) Field of Classification Search ..... 362/800, 362/803, 249.02, 311.02
See application file for complete search history.

(56) References Cited

U.S. PATENT DOCUMENTS

| | | | | |
|---|---|---|---|---|
| 2002/0130326 | A1 | 9/2002 | Tamura et al. | |
| 2006/0000963 | A1 | 1/2006 | Ng et al. | |
| 2006/0022935 | A1 | 2/2006 | Sakai et al. | |
| 2007/0170449 | A1 * | 7/2007 | Anandan | 257/98 |
| 2008/0093530 | A1 * | 4/2008 | Hoelen et al. | 250/201.1 |
| 2008/0150433 | A1 * | 6/2008 | Tsuchida et al. | 315/154 |

FOREIGN PATENT DOCUMENTS

| | | | |
|---|---|---|---|
| JP | 2002-344031 | A | 11/2002 |
| JP | 2003-068130 | A | 3/2003 |
| JP | 2005-019066 | A | 1/2005 |
| JP | 2006-019263 | A | 1/2006 |
| JP | 2006-040764 | A | 2/2006 |
| WO | WO 00/37904 | A1 | 6/2000 |

OTHER PUBLICATIONS

International Search Report for the Application No. PCT/JP2007/053320 mailed May 29, 2007.

* cited by examiner

*Primary Examiner* — Laura Tso
(74) *Attorney, Agent, or Firm* — Cheng Law Group, PLLC

(57) ABSTRACT

An LED luminaire is provided with a light emitting module composed of plural kinds of LEDs emitting lights of different colors, a lens unit having a lens for diffusing the mixed-color light from the light emitting module, a light output controller for controlling electric current fed to each of the LEDs, and a light sensor for sensing the light from the light emitting module. The light output controller performs feedback control on the electric current fed to each of the LEDs based upon light levels of the sensed light, so that the light emitted from the light emitting module has desired chromaticity. The lens unit contains a light guide for guiding the light from the lens to the light sensor and can guide the light from the light emitting module to the light sensor with a high efficiency.

21 Claims, 8 Drawing Sheets

LED LUMINAIRE

TECHNICAL FIELD

The present invention relates to a light emitting diode luminaire composed of LEDs of different colors to emit a light of desired chromaticity.

BACKGROUND ART

International Patent Publication No. WO0037904 discloses a conventional LED luminaire. The LED luminaire includes a circuit board mounting thereon plural kinds of LEDs of different colors (e.g., a red LED, a green LED, and a blue LED), a main body carrying the circuit board, and an optical member covering surfaces of the LEDs. In order to obtain a light of a desired chromaticity (e.g., white light), the LED luminaire further includes a single photodiode for detecting light outputs from all of the LEDs and a controller for performing a feedback control of regulating an amount of forward electric current to each LED in order to keep the light from the individual LED at a predetermined desired level. However, since the emitted light from each of LEDs is transmitted to the photodiode through an optical fiber, the LED luminaire has one disadvantage that it is difficult to detect light stably from all of the LEDs. Furthermore, since the control unit drives the red, green, and blue LEDs individually at short intervals and determines a light output level for each color, the LED luminaire has another disadvantage that it is difficult to adjust the chromaticity based upon the light of the mixed-color obtained from these LEDs, i.e., the light practically emitted from the LED luminaire.

SUMMARY OF THE INVENTION

The present invention has been developed in view of the above problems and aims to propose an LED luminaire which is capable of accurately adjusting a mixed-color light to develop the light of a desired chromaticity. The LED luminaire according to the present invention includes a light emitting module having plural kinds of LEDs of emitting lights of different colors to provide the mixed-color light, a mixture of the lights from the individual LEDs, a lens unit having a lens for diffusing the mixed-color light from the light emitting module, a light output controller for controlling an electric current fed to each of the LEDs in the light emitting module, and a light sensor for sensing the mixed-color light from the light emitting module. The light output controller is configured to perform feedback control on the electric current fed to each of the LEDs such that the mixed-color light from the light emitting module may be adjusted at a desired chromaticity, based upon the light output levels for specific colors detected by the light sensor. A characterizing feature of the present invention is that the lens unit includes a light guide for guiding the mixed-color light from the lens to the light sensor. With the provision of the light guide, the mixed-color light, i.e., the mixture of the lights from all of the LEDs can be transmitted to the light sensor efficiently, enabling to accurately adjust the chromaticity of the mixed-color light.

The LED luminaire in accordance with the present invention further includes a memory unit for storing reference values of the light levels for the specific colors that defines the predetermined chromaticity, such as red, green, and blue. The light output controller controls the electric current fed to each of the LEDs based upon the reference values stored in the memory unit. Consequently, the luminaire can be realized to generate the lights of different values of chromaticity by selection of the reference values for the light level for each color in the memory unit.

The light sensor preferably includes a plurality of color filters each selectively passing the light of each specific color, and a plurality of level sensors each detecting the light level of the specific color passed through each of the color filters. Thus, it is possible to detect the light level of the specific colors emitted simultaneously and individually from the plural kinds of LEDs in the light emitting module.

Alternatively, the light sensor may be composed of a spectroscopic element for spectrally diffracting the mixed-color light from at least one light-emitting module into the lights of the specific colors, and a level sensor for detecting the light level for each of the specific colors obtained by means of the spectroscopy.

It is preferred that a light collecting part is formed integrally with the light lens unit in a vicinity of the light sensor. In this case, the light guide has a cross-sectional area which decreases towards the light collecting part than at a portion close to the light sensor so as to effectively transmit the mixed-color light to the light sensor.

The present invention is preferred to include a plurality of the light emitting modules which are located at different positions with their respective lens spaced from the light sensor by the individual light guides of different optical path lengths. The light guide is configured to have a greater cross-sectional area than the light guide of shorter light path length. With this arrangement, it is possible to feed the light at a uniform amount from a plurality of the light emitting modules to the light sensor, irrespective of differing optical length of the light guides, thereby giving the light of desired chromaticity to the entire light from the combination of the light emitting modules The light sensor may be mounted together with the light emitting module on a circuit board supported by a main body. In this case, the distance of the light guide from the lens unit to the light sensor can be shortened to realize the lens unit with a simple configuration.

Alternatively, the light sensor may be disposed on a back surface of the main body. In this case, the light guide extends from a front surface of the main body to the back surface through the circuit board mounting the light emitting module, and is coupled to the light sensor.

Moreover, the light sensor may be incorporated into a control unit provided separately from the main body. In this case, the light guide extends to the back surface of the main body through the circuit board, and is coupled to the light sensor by means of an optical fiber. With the above configuration, the mixed-color light from the light emitting module can be efficiently transmitted to the control unit provided separately from the main body, for increasing design flexibility of the LED luminaire.

Furthermore, the lens unit is preferably provided with a reflector. The reflector reflects the external light entering from a front side of the lens unit, such that the light from the light emitting module is directed from the light guide into a path leading to the light sensor for reducing disturbances caused by an ambient light. Consequently, the light sensor can detect the mixed-color light only from the light emitting module for accurate adjustment of chromaticity.

The reflector may be formed on one side of faces of a hollow cavity formed in the lens unit. With the reflector thus formed in the lens unit, the mixed-color light guided from the lens can be reflected toward the light sensor, so as to be efficiently collected at the light sensor.

Furthermore, the LED luminaire according to the present invention can be configured to emit the light of chromaticity in match with that of an ambient light. In this case, an ambient light sensor for detecting the ambient light is provided to detect light levels for the specific colors corresponding to the colors of the lights emitted from the plural kinds of the LEDs. The detected light levels are output to the light output controller which controls the electric current fed to each of the LEDs in at least one light emitting module such that a ratio of the light levels of the mixed-color light becomes equal to that of the light levels output from the ambient light sensor. With this configuration, the LED luminaire can emit the light that has almost the same chromaticity as that of another coexisting luminaires. Consequently, it is possible to emit the light of a uniform chromaticity over a wide range with the use of the plural LED luminaires.

BEST MODE FOR CARRYING OUT THE INVENTION

Figure 1:
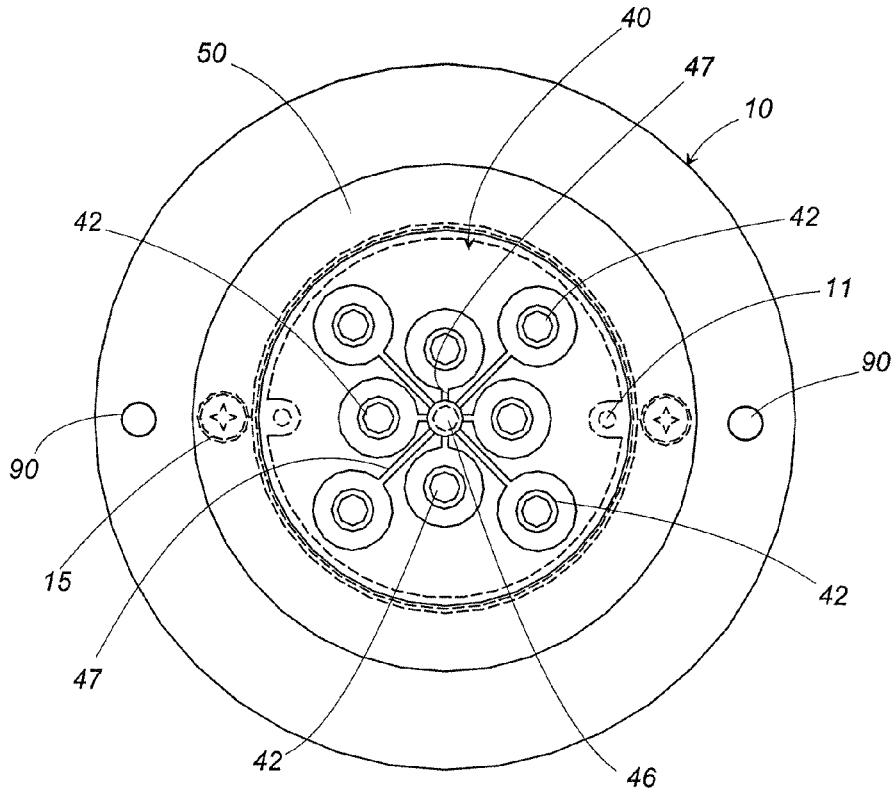
FIG. 1 is a bottom view of an LED luminaire in accordance with a first embodiment of the present invention.

The LED luminaire in accordance with a first embodiment of the present invention will be described with reference to FIGS. 1 to 10. The LED luminaire in accordance with this embodiment is configured as a ceiling light. As shown in FIG. 2, the LED luminaire includes a disc-shaped main body 10 attached to a ceiling 100, a plurality of light emitting modules 20 arranged on a front surface of the main body 10, and a lens unit 40 covering a plurality of the light emitting modules 20 on the front surface of the main body 10. As shown in FIG. 5, a circular recess 12 is formed on the front surface of the main body 10 to accommodate a plurality of the light emitting modules 20 and the lens unit 40. Furthermore, a decorative ring 50 is attached to a periphery of the recess 12 of the main body 10 to surround the lens unit 40, while concealing screws 15 used for securing the main body 10 to the ceiling 100. As shown in FIG. 8, the decorative ring 50 is removably attached to the main body 10 with hooks 52 projecting from a back surface of the decorative ring 50 to engage with holes 14.

Figure 4:
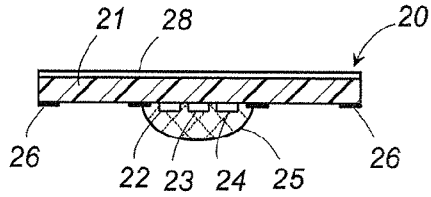
FIG. 4 is a cross sectional view of a light emitting module of the LED luminaire in the above embodiment.
Figure 5:
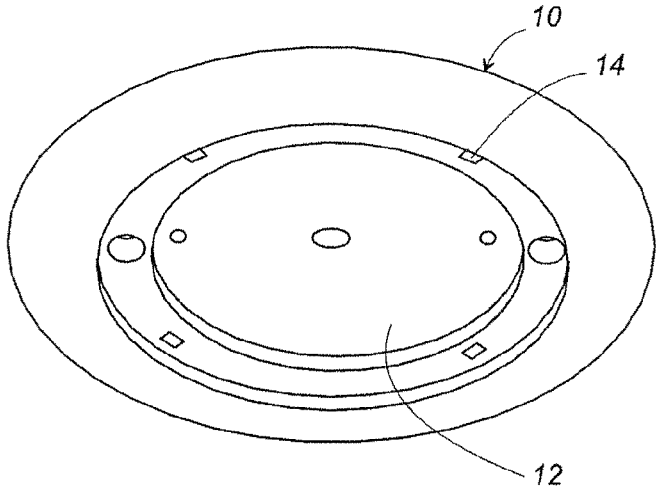
FIG. 5 is a perspective view of a main body of the LED luminaire in the above embodiment.

As shown in FIG. 4, each light emitting module 20 is configured to emit a white light by combination of the plural LEDs emitting the lights of different colors, i.e., a red LED 22, a green LED 23, and a blue LED which are arranged on the surface of a substrate 21. The LEDs are prepared as bare chips, and these bare chips are electrically connected to circuit patterns formed on the substrate 21 by wire bonding. The LEDs and the wires are encapsulated with transparent sealing resins (e.g., silicone resins or an epoxy resins), to form a light emitting part 25 enclosing the LEDs. It is noted that the LEDs may be mounted on the substrate 21 by a flip-chip technique. Electrodes 26 electrically connected to the LEDs through the circuit pattern are formed on a periphery of the surface of the substrate 21. Also, an organic green sheet 28 made of a dielectric material with a high thermal conductivity is formed on the back surface of the substrate 21. Since the organic green sheet 28 is secured to the main body 10 made of metals with a higher thermal conductivity such as aluminum or copper, the heat generated in the LEDs is diffused to the main body 10.

The plural light emitting modules 20 are mounted on a single circuit board 30 which is accommodated in the circular recess 12 formed in the front surface of the main body 10, and are arranged around a center of the main body 10. In the circuit board 30, a plurality of circular openings 34 are formed such that the light emitting part 25 of each light emitting module 20 is exposed at each of the openings 34. The electrodes 26 on the periphery of the surface of the substrate 21 in each light emitting module 20 are electrically connected to the circuit patterns formed on a back surface of the circuit board 30. As a result of securing the organic green sheet 28, which is formed on the opposite surface of the substrate 21 in each light emitting module 20, to the main body 10, the circuit board 30 is held in the main body 10. The organic green sheet 28 is formed of a thermoplastic resin sheet material with the high thermal conductivity and a high fluidity when heated. The material may be an epoxy resin layer highly filled with a filler (e.g. a silica or an alumina), or the like. The organic green sheet 28 is secured to the main body 10 by its plastic deformation when heated.

An electronic circuit of a light output controller 60 is composed of the circuit board 30 mounting thereon electronic components, and modifies a chromaticity of the light emitted from the light emitting module 20 by controlling the electric current fed to each of LED 22, 23, and 24 in each light emitting module 20. A power source unit 110 is disposed on a back surface of the main body 10 to supply an electric power to the light output controller 60 through wires 32.

Figure 6:
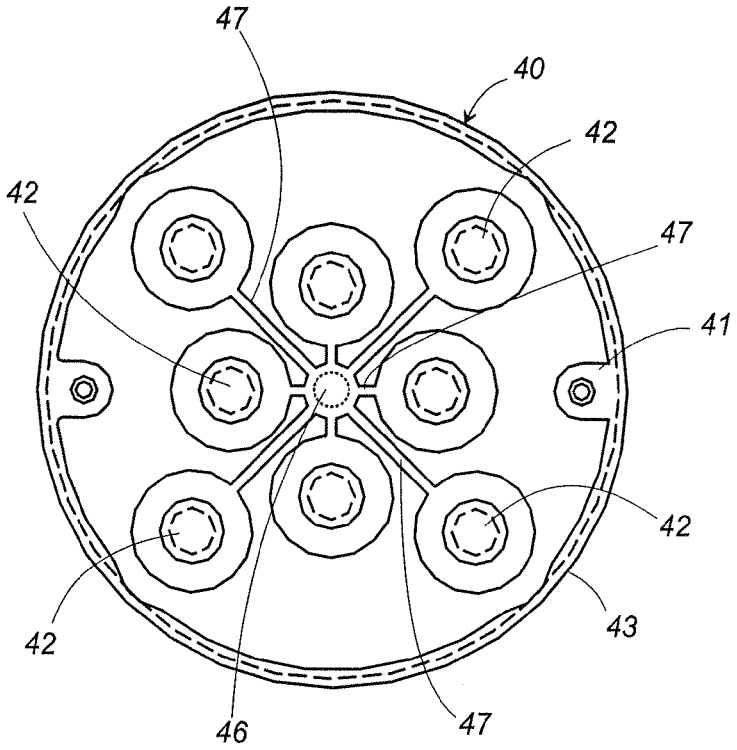
FIG. 6 is a bottom view of a lens unit of the LED luminaire in the above embodiment.
Figure 7:
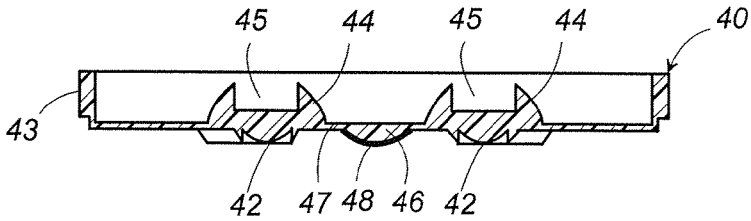
FIG. 7 is a cross sectional view of the above lens unit.
Figure 8:
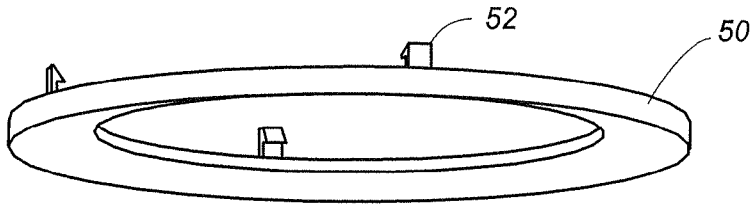
FIG. 8 is a perspective view of a decorative ring of the LED luminaire in the above embodiment.

As shown in FIGS. 6 and 7, the lens unit 40 is molded from a transparent material to include a plurality of lenses 42 respectively corresponding to the light emitting modules 20, and fastened to a front surface of the main body 10 with screws 11 in order to conceal a front surface of the circuit board 30. The screws 11 are inserted from the back surface of the main body 10 into bosses 41 formed in a peripheral portion of the lens unit 40. A side wall 43 is formed in the periphery of the lens unit 40 such that the lens unit is fitted within the periphery of the circular recess 12 of the main body 10. Each lens 42 is designed as a Fresnel lens to distribute the light emitted from the light emitting module 20. Each lens 42 has a bulge 44 projecting towards the circuit hoard 30. An upper periphery of the bulge 44 comes into contact with a periphery of the circular opening 34 of the circuit board 30 to align each lens with each light emitting module 20. The light emitting part 25 of the light emitting module 20 is accommodated in a concavity 45 formed in a top end of the bulge 44. The outer shape of the bulge 44 is designed such that the light traveling from a side wall of the concavity 45 is reflected inwardly and led to an emitting surface of the lens 42.

The lens unit 40 includes a light guide 47 for guiding the light emitted from each light emitting module 20 partially into a light collecting part 46 formed at a center of the lens unit 40. The light collecting part 46 is shaped into a convex lens to direct the collected light toward the light sensor 80 disposed on circuit board 30. On the outer surface of the light collecting part 46, a film of reflector 48 is formed in order to prevent ambient light from entering into the light sensor 80. The whole lens unit 40 is molded from a transparent material, e.g., acrylic resin, polycarbonate resin, and glass, or a combination of transparent material and metallic material. In the latter case, when the light guide 47 and light collecting part 46 are made of transparent materials and the remaining parts are made of metal materials, it is possible to promote the dissipation of heat caused by light emitting of the LEDs.

The light sensor 80 includes three kinds of color filters (not illustrated) passing therethrough selectively each of the lights emitted from the red LED 22, the green LED 23, and the blue LED 24, and a light level sensor (not illustrated) composed of a plurality of photodiodes having a photo-sensitivity over a whole frequency range of visual light. The light sensor 80 detects light levels of red, green, and blue simultaneously, and then outputs the light levels to the light output controller 60. It is noted that only one level sensor may be used to detect the light level of each color at predetermined time intervals by time-division processing.

Figure 9:
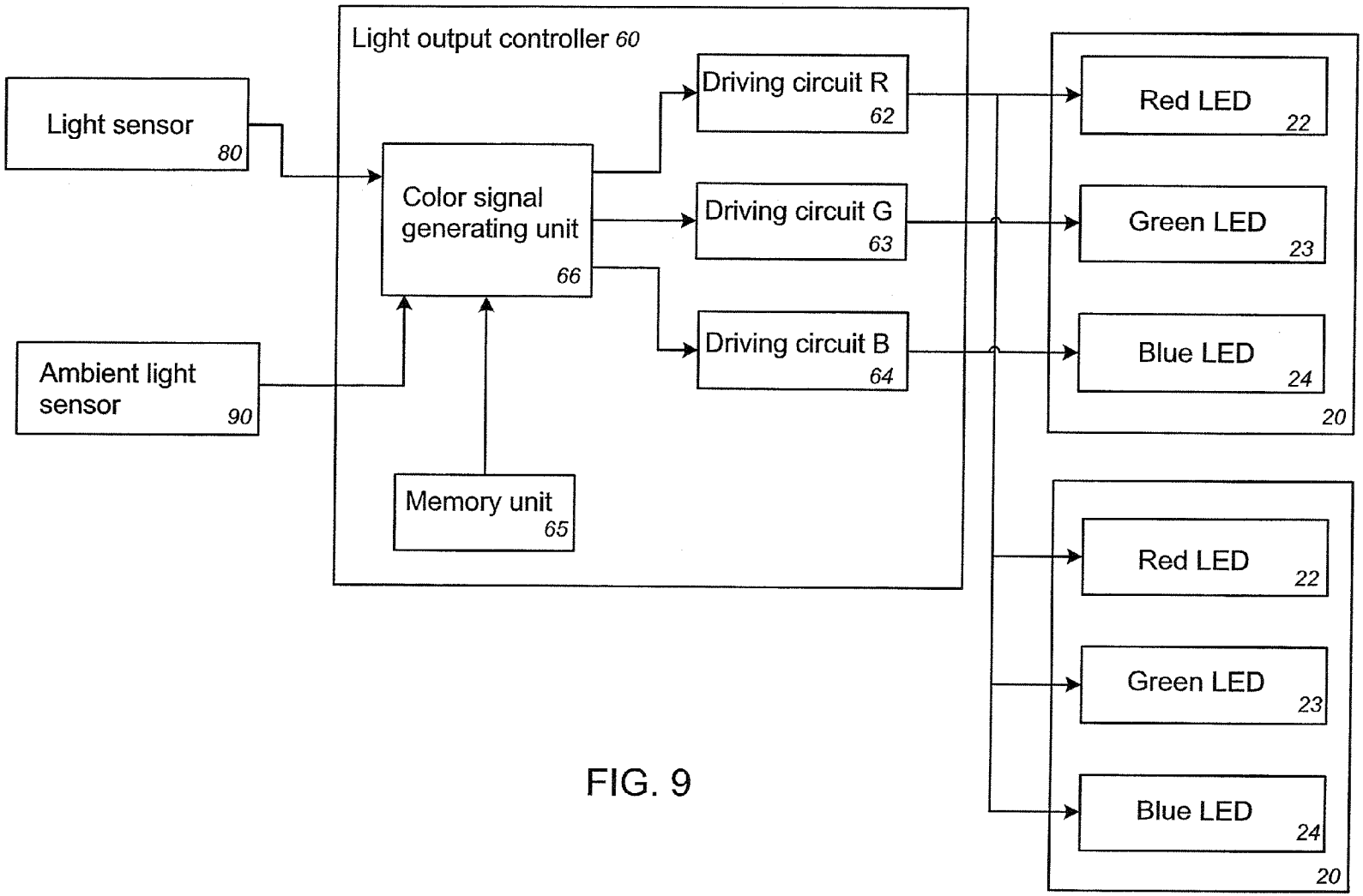
FIG. 9 is a block diagram showing a circuit configuration of the LED luminaire in the above embodiment.

As shown in FIG. 9, the light output controller 60 is provided with a memory unit 65 and a color signal generating unit 66. The memory unit 65 stores a reference value of light level for each of red, green, and blue, and the color signal generating unit 66 determines a current command for each color such that the LED 22, 23, and 24 emit the lights of which the intensities are based upon the reference values. Upon receiving the current commands, a driving circuit R62, a driving circuit G63, and a driving circuit B64 operate to feed the electric currents to the LEDs 22, 23, and 24 respectively, causing the light emission from the LEDs in each of the light emitting modules 20. Typically, the memory unit 65 is arranged to determine reference values so as to realize a white-color light from the light emitting modules 20 by mixing the luminescent colors of the LEDs.

The light level for each color of the light detected by the light sensor 80 is sent to the color signal generating unit 66. The light output controller 60 is configured to perform the feedback control for determining the individual current commands such that the light level coincides with the reference value stored in the memory unit 65, in order to maintain a constant chromaticity of the light emitted from each light emitting module 20.

Figure 2:
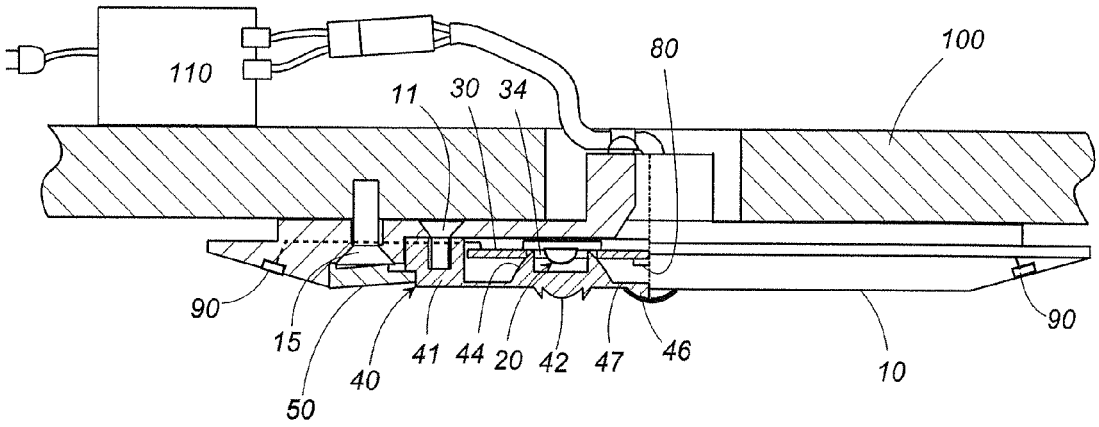
FIG. 2 is a partly broken away front view of the LED luminaire in the above embodiment.
Figure 3:
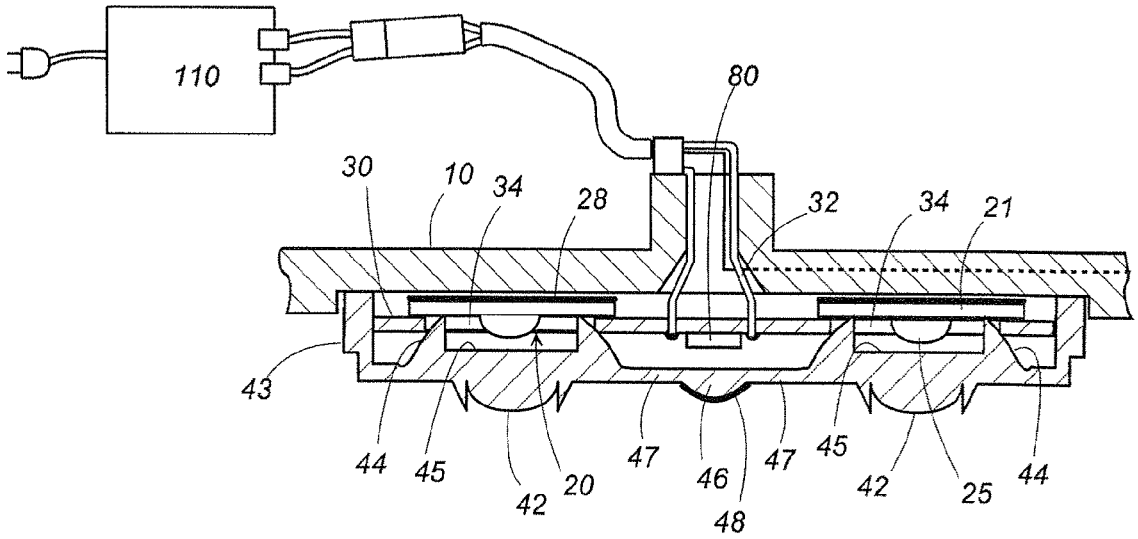
FIG. 3 is a cross sectional view of the LED luminaire in the above embodiment.

In the LED luminaire in accordance with the embodiment, as shown in FIGS. 1 and 6, a plurality of the lenses 42 are arranged to be spaced at different distances from the light collecting part 46 located at the center of the lens unit 40, thereby making a difference in optical path lengths of the light guides 47 extending from each light emitting module 20 to the light sensor 80 have optical path lengths different from each other. Due to the differing optical lengths of the individual light paths, there would be inherent variations in an amount of the light leading to the light sensor 80. In order to avoid the variations, the light guide 47 of a longer optical path is designed to have a larger cross-section than that of a shorter optical path, thereby assuring higher accuracy of detecting a chromaticity of the light emitted from the whole LED luminaire.

Figure 10:
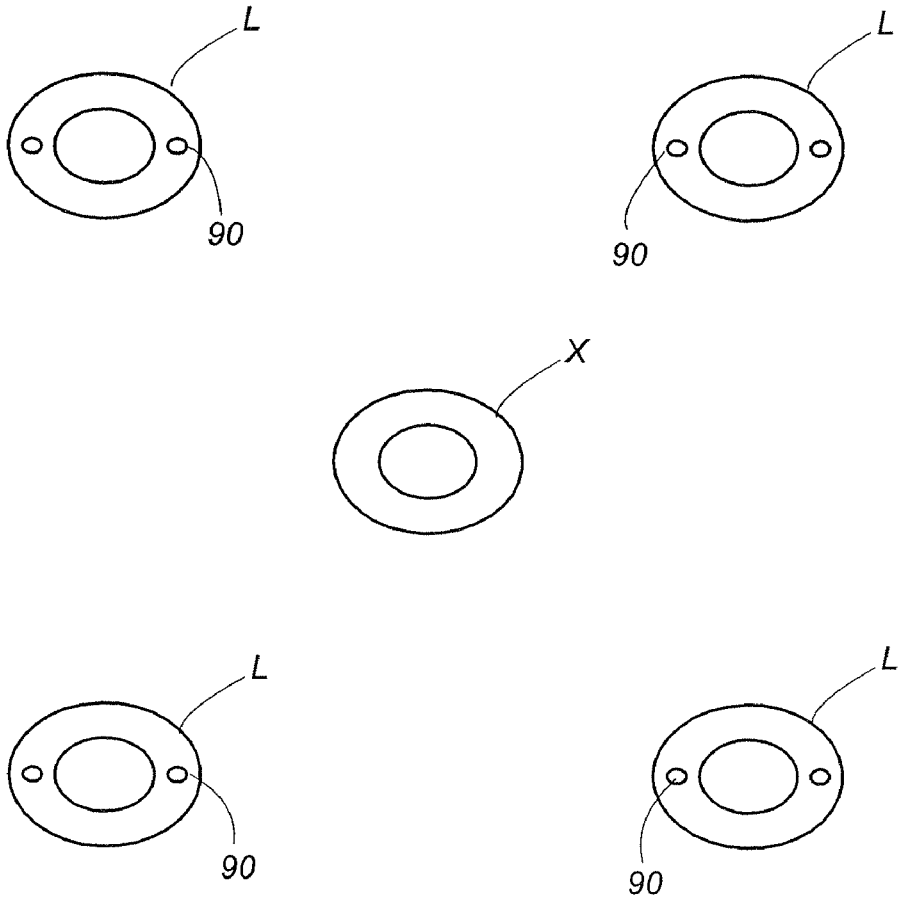
FIG. 10 is a schematic view of one example of the LED luminaire in the above embodiment.

The LED luminaire in accordance with the embodiment, in addition to the light sensor 80 for sensing the light emitted from each light emitting module 20, may be provided with an ambient light sensor 90 for sensing ambient light to perform an additional matching function in which the light emitting module 20 can emit the light in match with a chromaticity of the light emitted from an ambient light source. Like the above light sensor 80, the ambient light sensor 90 is disposed on the periphery of the front surface of the main body 10 in order to detect light levels for red, green, and blue color independently. For performing the matching function, the color signal generating unit 66 is arranged to receive light levels for the three colors of the light detected by the ambient light sensor 90, instead of utilizing the reference current command stored in the memory unit 65. Then, the color signal generating unit 66 determines the current commands based upon a ratio of the detected light levels for the three colors. Thus, the determined current commands are fed to the LED 22, 23, and 24 such that the chromaticity of the light from each light output module 20 matches with that of the ambient light. FIG. 10 shows one example of an illumination system using the above matching function. The illumination system is configured to arrange a plurality of LED luminaires "L" around a reference luminaire "X" in order to conform the chromaticity of the light emitted from the reference luminaire to those of the lights from the LED luminaires located around it.

In the embodiment, the feedback control is made to regulate the electric current to each LED based upon an average value of light levels of each color detected by the two ambient light sensors 90. The two ambient light sensors 90 are positioned on the periphery of the main body 10 opposite to each other in its diametrical direction. The number of the ambient light sensors 90 is not limited to two, but may be one or more than two. When being provided with a plurality of ambient light sensors 90, the LED luminaire may include a switch for selectively deactivating one or more ambient light sensors 90 for selecting only the necessary ambient light, while eliminating the influence of undesired ambient light.

Figure 11:
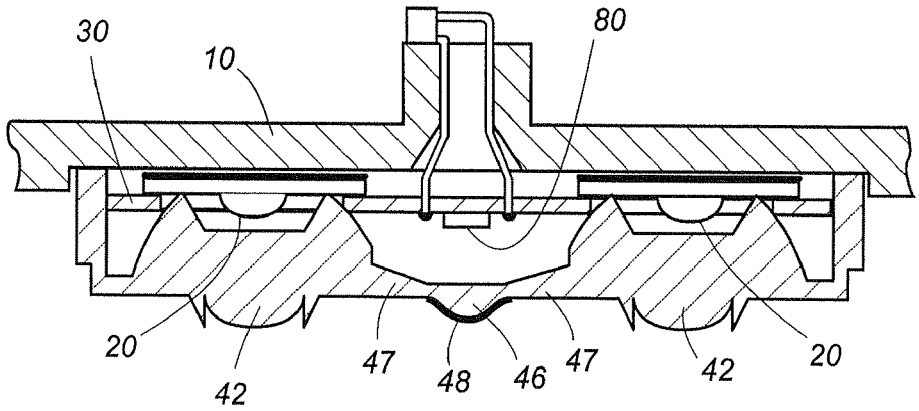
FIG. 11 is a cross sectional view showing a first modification of the LED luminaire in the above embodiment.

FIG. 11 shows a first modification in the above embodiment. The embodiment is configured to decrease gradually the cross-sectional area, which means the thickness, of the light guide 47 extending from the lens 42 to the light collecting part 46 in a direction toward the light collecting part 46, in order to improve light transmitting efficiency of the light entering into the light collecting part 46.

Figure 12:
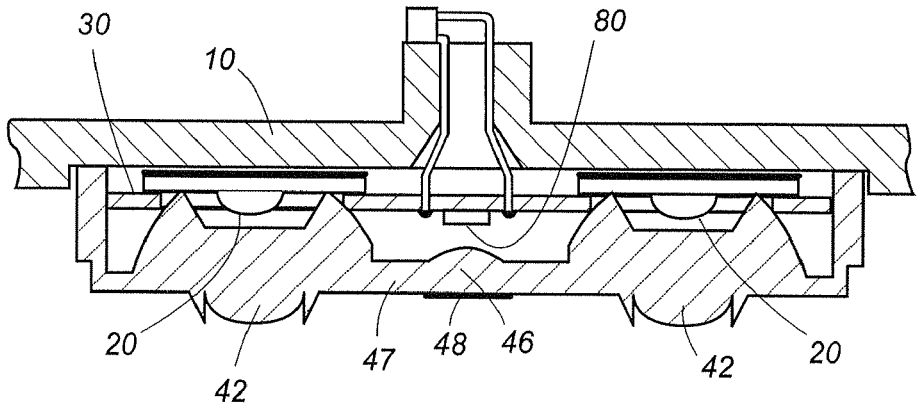
FIG. 12 is a cross sectional view showing a second modification of the LED luminaire in the above embodiment.

FIG. 12 shows a second modification in the above embodiment, in which the projecting portion of the light collecting part 46 is formed on the back surface of the lens unit 40 facing to the light sensor 80.

Figure 13:
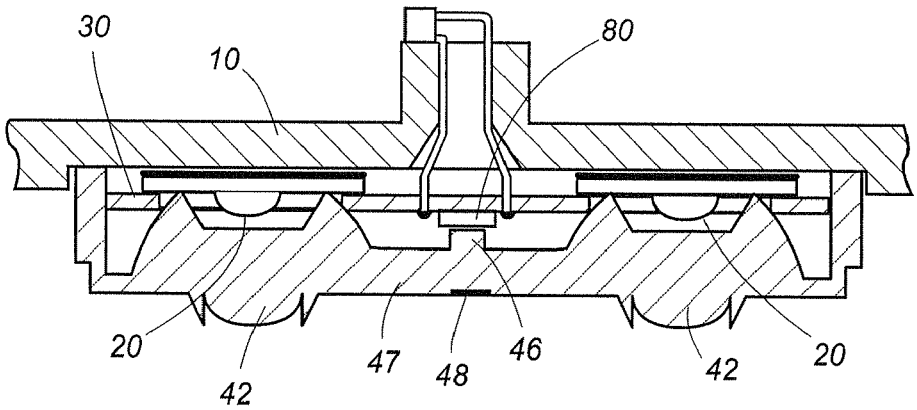
FIG. 13 is a cross sectional view showing a third modification of the LED luminaire in the above embodiment.

FIG. 13 shows a third modification in the above embodiment. The modification is configured to have the light collecting part 46 of which back surface projects towards the light sensor 80 from the reflector 48 embedded in the center of the front surface of the lens unit 40 corresponding to the light sensor 80.

Figure 14:
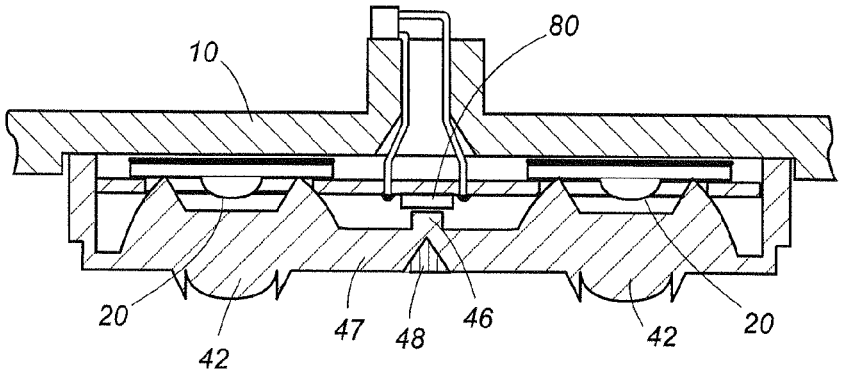
FIG. 14 is a cross sectional view showing a fourth modification of the LED luminaire in the above embodiment.

FIG. 14 shows a fourth modification in the above embodiment. The modification is configured such that the reflector 48 of a triangular cross section is embedded in the center of the front surface of the lens unit 40 in order to prevent an external light from entering into the light sensor 80 and simultaneously reflect the light passing through the light guide 47 toward the light sensor 80. This configuration enhances incident efficiency of the light entering into the light sensor 80.

Figure 15:
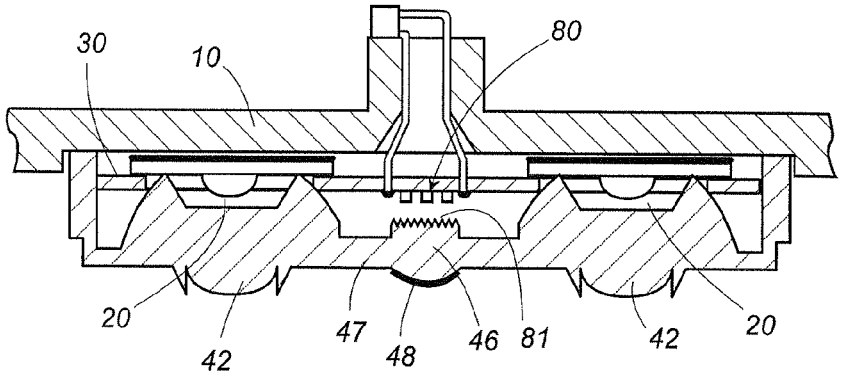
FIG. 15 is a cross sectional view showing a fifth modification of the LED luminaire in the above embodiment.
Figure 16:
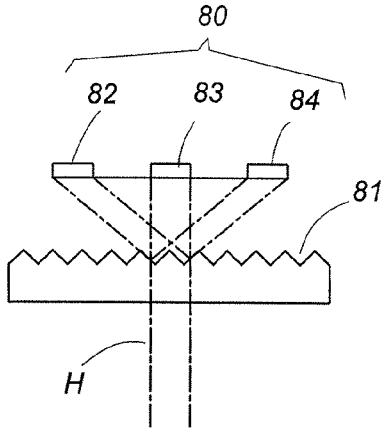
FIG. 16 is a schematic view of a color filter of the LED luminaire shown in FIG. 14.

FIGS. 15 and 16 show a fifth modification in the above embodiment. In the modification, the light sensor 80 is composed of a spectroscopic element 81 by which the light "H" transmitted through the light guide 47 is spectrally diffracted into each color of red, green, and blue, and a plurality of photodiodes 82, 83, and 84 functioning as a level sensor for detecting the light level of each color diffracted spectrally. As shown in FIG. 15, although the spectroscopic element 81 is formed as a diffraction grating on the back surface of the light collecting part 46 in the lens unit 40, it may be separately formed from the lens unit 40.

Figure 17:
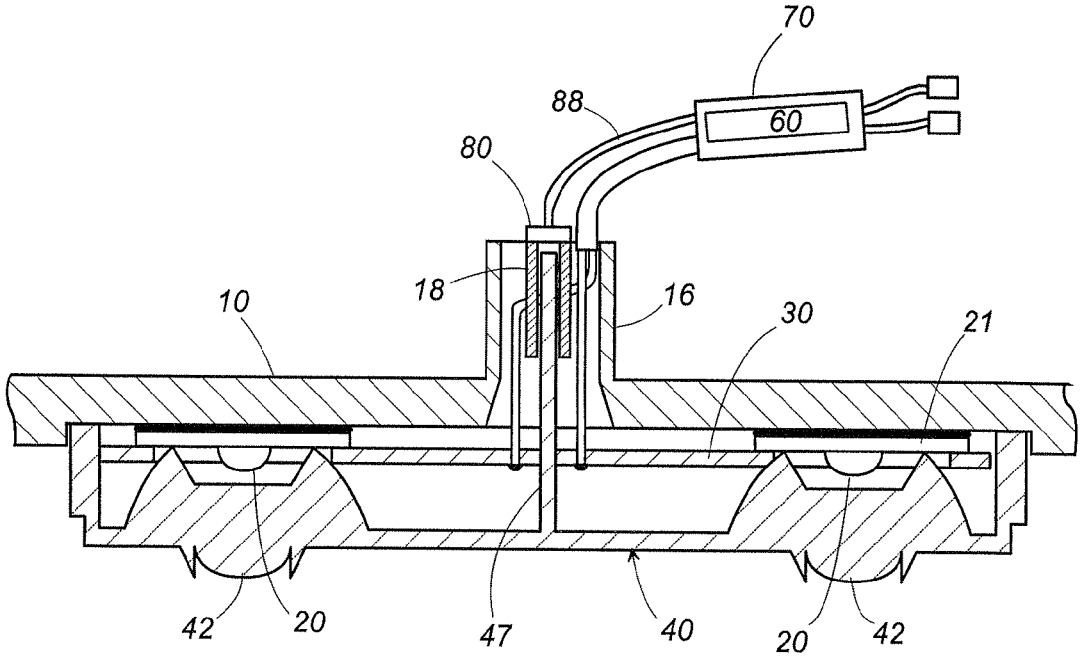
FIG. 17 is a cross sectional view of an LED luminaire in accordance with a second embodiment of the present invention.

FIG. 17 shows an LED luminaire in accordance with a second embodiment of the present invention. The LED luminaire includes the light sensor 80 which is arranged at the back surface of the main body 10 to electrically to electrically connect through a wire 88 with the light output controller 60 accommodated in a control unit 70 disposed separately from the main body 10. In this case, the light guide 47 formed in the lens unit 40 is configured to extend from the center of the back surface of the lens unit 40 to the back surface of the main body 10 through the circuit board 30, and optically coupled to the light sensor 80. The main body is formed at its back surface with a tube 16 holding a thermal insulation sleeve 18 which supports the light sensor 80 at its one end for reducing the insulation sleeve from the main body 10. A front end of the light guide 47 is inserted into the thermal insulation sleeve 18, and outputs the light from the lens 42 to the light sensor 80. The control unit 70 is connected to a power source unit to feed an electric power to each of the LEDs. Other parts are like those of the first embodiment, so that like parts are designated by like reference numerals.

Figure 18:
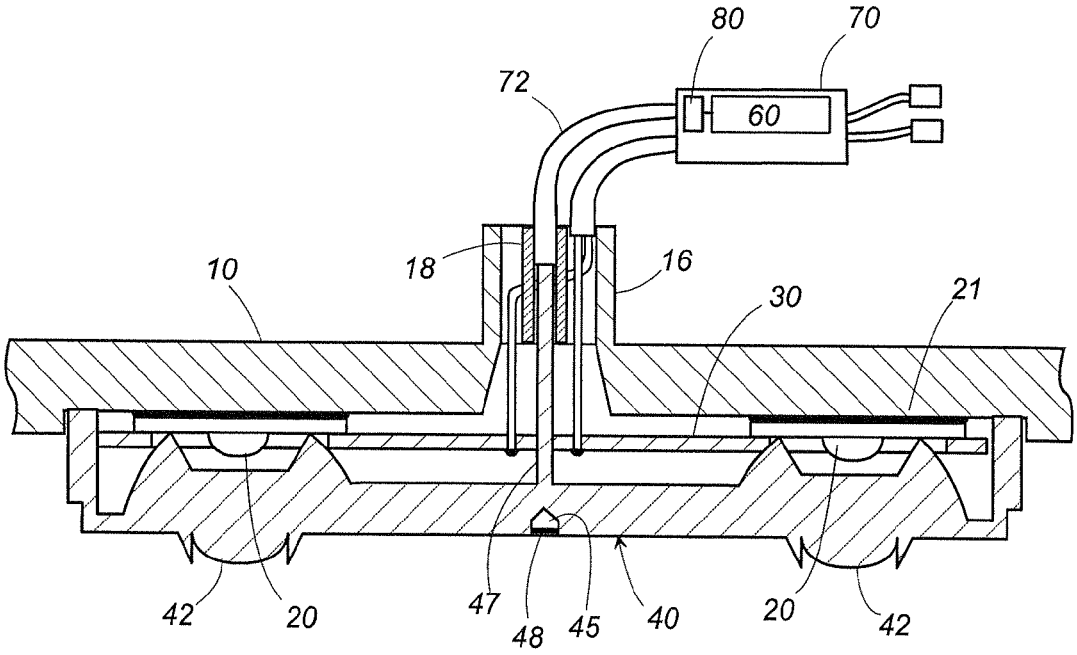
FIG. 18 is a cross sectional view showing a first modification of the LED luminaire in the above embodiment.

FIG. 18 shows a first modification of the second embodiment. In this modification, the control unit 70 is provided separately from the main body 10, and accommodates therein the light sensor 80 together with the light output controller 60, and the light guide 47 extending from the center of the back surface of the lens unit 40 is optically coupled to the light sensor 80 through an optical fiber 72. The tip of the light guide 47 is inserted into the thermal insulation sleeve 18 which is embedded within the tube 16 projecting to the back surface of the main body 10. Here, the tip is connected to one end of the optical fiber 72. The other end of the optical fiber 72 is coupled to the light sensor 80 in the control unit 70. The modification also includes a hollow cavity 45 at the center of the lens unit 40. A film of the reflector 48 is provided on the wall of hollow cavity 45, preventing the light from traveling to the light guide 47 extending from the back surface opposite to the hollow cavity 45 after being incident from the front surface of the lens unit 40.

Individual features shown in each of the above embodiments and modifications can be replaced or combined with the features shown in another embodiments and modifications. Such configurations are also included in the scope of the present invention.

Furthermore, although the above embodiments describe an example in which each light emitting module is composed of the red LED 22, the green LED 23, and the blue LED 24, the present invention is not limited to the composition. A desired mixed color may be obtained by combining any LEDs emitting the lights of colors other than red, green, and blue.

The invention claimed is:

1. A light emitting diode (LED) luminaire comprising:

at least one light emitting module having plural kinds of LEDs emitting lights of different colors to emit a mixed-color light which is a mixture of the lights from the individual LEDs;

a lens unit having a lens for directing the light from said at least one light emitting module;

a light output controller for controlling an electric current fed to each of the plural kinds of said LEDs in said at least one light emitting module;

a light sensor for sensing the mixed-color light from said at least one light emitting module; and a light guide for guiding the mixed-color light from the lens to the light sensor, the light guide being integrally formed in said lens unit, wherein the light sensor is configured to extract, from the mixed-color light, light levels respectively for specific colors respectively corresponding to the colors of the lights emitted from the plural kinds of the LEDs, wherein the light output controller is configured to perform feedback control on the electric current fed to each of the plural kinds of LEDs based upon the light levels extracted by the light sensor such that the light of mixed-color from said at least one light emitting module has desired chromaticity, and wherein said LED luminaire further comprises a reflector formed on the side of said lens unit and configured to reflect an external light which enters from a front surface of the lens, preventing said external light from entering into a path extending from the light guide to the light sensor.

2. The LED luminaire as set forth in claim 1, further comprising:

a memory means for storing a reference value for each of the light levels for the specific colors that determines said desired chromaticity, wherein the light output controller controls the electric current fed to each of the plural kinds of LEDs based on the reference values stored in the memory means.

3. The LED luminaire as set forth in claim 1, wherein the light sensor comprises:

a plurality of color filters configured to selectively pass the lights of the specific colors; and a plurality of level sensors configured to detect respective light levels for the specific colors of lights passing through a plurality of said color filters.

4. The LED luminaire as set forth in claim 1, wherein the light sensor comprises:

a spectroscopic element for spectrally diffracting the mixed-color light into the lights of the specific colors; and a level sensor detecting a light level for each of the specific colors diffracted by said spectroscopic element.

5. The LED luminaire as set forth in claim 1, wherein a light collecting part is formed integrally with said light lens unit close to said light sensor, and wherein said light guide has a cross-sectional area which is smaller towards the light collecting part than at a portion close to said lens.

6. The LED luminaire as set forth in claim 1, wherein a plurality of said light emitting modules are located at different positions with their associated lens spaced from said light sensor by the individual light guides of different optical lengths, and wherein said light guide has a greater cross-sectional area than the light guide of shorter optical length.

7. The LED luminaire as set forth in claim 1, further comprising:

a circuit board mounting thereon said at least one light emitting module and said light sensor; and a main body supporting the circuit board.

8. The LED luminaire as set forth in claim 1, further comprising:

a circuit hoard mounting thereon said at least one light emitting module; and a main body supporting said circuit board at a front surface thereof, wherein said light guide extends to a back surface of the main body through said circuit board to be coupled to said light sensor disposed on the back surface of the main body.

9. The LED luminaire as set forth in claim 1, further comprising:

a main body;

a control unit provided separately from the main body to accommodate therein said light sensor; and a circuit board configured to mount said at least one light emitting module, wherein said circuit board is supported on a front surface of the main body, and wherein said light guide extends to a back surface of the main body through said circuit board, and is coupled by means of an optical fiber to said light sensor.

10. The LED luminaire as set forth in claim 1, wherein said reflector is provided on one of faces of a hollow cavity formed in said lens unit.

11. The LED luminaire as set forth in claim 1, wherein said reflector is formed within the lens unit to reflect the light proceeding from the lens toward the light sensor.

12. The LED luminaire as set forth in claim 1, further comprising:

an ambient light sensor for sensing an ambient light, wherein the ambient light sensor extracts, from the ambient light, light levels for specific colors corresponding to the colors of the lights emitted from the plural kinds of said LEDs and outputs the light levels to said light output controller, and wherein the light output controller controls the electric current fed to each of the plural kinds of said LEDs in the light emitting module so that the mixed-color light from the light emitting module has the same ratio of the light levels as that of the light levels output from the ambient light sensor.

13. A light emitting diode (LED) luminaire comprising:

at least one light emitting module having plural kinds of LEDs emitting lights of different colors to emit a mixed-color light which is a mixture of the lights from the individual LEDs;

a lens unit having a lens for directing the light from said at least one light emitting module;

a light output controller for controlling an electric current fed to each of the plural kinds of said LEDs in said at least one light emitting module;

a light sensor for sensing the mixed-color light from said at least one light emitting module; and a light guide for guiding the mixed-color light from the lens to the light sensor, the light guide being integrally formed in said lens unit, wherein the light sensor is configured to extract, from the mixed-color light, light levels respectively for specific colors respectively corresponding to the colors of the lights emitted from the plural kinds of the LEDs, wherein the light output controller is configured to perform feedback control on the electric current fed to each of the plural kinds of LEDs based upon the light levels extracted by the light sensor such that the light of mixed-color from said at least one light emitting module has desired chromaticity, wherein a light collecting part is formed integrally with said light lens unit close to said light sensor, and wherein said light guide has a cross-sectional area which is smaller towards the light collecting part than at a portion close to said lens.

14. A light emitting diode (LED) luminaire comprising:

at least one light emitting module having plural kinds of LEDs emitting lights of different colors to emit a mixed-color light which is a mixture of the lights from the individual LEDs;

a lens unit having a lens for directing the light from said at least one light emitting module;

a light output controller for controlling an electric current fed to each of the plural kinds of said LEDs in said at least one light emitting module;

a light sensor for sensing the mixed-color light from said at least one light emitting module; and a light guide for guiding the mixed-color light from the lens to the light sensor, the light guide being integrally formed in said lens unit, wherein the light sensor is configured to extract, from the mixed-color light, light levels respectively for specific colors respectively corresponding to the colors of the lights emitted from the plural kinds of the LEDs, wherein the light output controller is configured to perform feedback control on the electric current fed to each of the plural kinds of LEDs based upon the light levels extracted by the light sensor such that the light of mixed-color from said at least one light emitting module has desired chromaticity, wherein a plurality of said light emitting modules are located at different positions with their associated lens spaced from said light sensor by the individual light guides of different optical lengths, and wherein said light guide has a greater cross-sectional area than the light guide of shorter optical length.

15. A light emitting diode (LED) luminaire comprising:

at least one light emitting module having plural kinds of LEDs emitting lights of different colors to emit a mixed-color light which is a mixture of the lights from the individual LEDs;

a lens unit having a lens for directing the light from said at least one light emitting module;

a light output controller for controlling an electric current fed to each of the plural kinds of said LEDs in said at least one light emitting module;

a light sensor for sensing the mixed-color light from said at least one light emitting module; and a light guide for guiding the mixed-color light from the lens to the light sensor, the light guide being integrally formed in said lens unit, wherein the light sensor is configured to extract, from the mixed-color light, light levels respectively for specific colors respectively corresponding to the colors of the lights emitted from the plural kinds of the LEDs, wherein the light output controller is configured to perform feedback control on the electric current fed to each of the plural kinds of LEDs based upon the light levels extracted by the light sensor such that the light of mixed-color from said at least one light emitting module has desired chromaticity, wherein said LED luminaire further comprises:

a circuit board mounting thereon said at least one light emitting module; and a main body supporting said circuit board at a front surface thereof, wherein said light guide extends to a back surface of the main body through said circuit board to be coupled to said light sensor disposed on the back surface of the main body.

16. A light emitting diode (LED) luminaire comprising:

at least one light emitting module having plural kinds of LEDs emitting lights of different colors to emit a mixed-color light which is a mixture of the lights from the individual LEDs;

a lens unit having a lens for directing the light from said at least one light emitting module;

a light output controller for controlling an electric current ted to each of the plural kinds of said LEDs in said at least one light emitting module;

a light sensor for sensing the mixed-color light from said at least one light emitting module; and a light guide for guiding the mixed-color light from the lens to the light sensor, the light guide being integrally formed in said lens unit, wherein the light sensor is configured to extract, from the mixed-color light, light levels respectively for specific colors respectively corresponding to the colors of the lights emitted from the plural kinds of the LEDs, wherein the light output controller is configured to perform feedback control on the electric current fed to each of the plural kinds of LEDs based upon the light levels extracted by the light sensor such that the light of mixed-color from said at least one light emitting module has desired chromaticity, wherein said LED luminaire further comprises:

a main body;

a control unit provided separately from the main body to accommodate therein said light sensor; and a circuit board configured to mount said at least one light emitting module, wherein said circuit board is supported on a front surface of the main body, and wherein said light guide extends to a back surface of the main body through said circuit board, and is coupled by means of an optical fiber to said light sensor.

17. A light emitting diode (LED) luminaire comprising:

at least one light emitting module having plural kinds of LEDs emitting lights of different colors to emit a mixed-color light which is a mixture of the lights from the individual LEDs;

a lens unit having a lens for directing the light from said at least one light emitting module;

a light output controller for controlling an electric current fed to each of the plural kinds of said LEDs in said at least one light emitting module;

a light sensor for sensing the mixed-color light from said at least one light emitting module; and a light guide for guiding the mixed-color light from the lens to the light sensor, the light guide being integrally formed in said lens unit, wherein the light sensor is configured to extract, from the mixed-color light, light levels respectively for specific colors respectively corresponding to the colors of the lights emitted from the plural kinds of the LEDs, wherein the light output controller is configured to perform feedback control on the electric current fed to each of the plural kinds of LEDs based upon the light levels extracted by the light sensor such that the light of mixed-color from said at least one light emitting module has desired chromaticity, wherein said LED luminaire further comprises:

an ambient light sensor for sensing an ambient light, wherein the ambient light sensor extracts, from the ambient light, light levels for specific colors corresponding to the colors of the lights emitted from the plural kinds of said LEDs and outputs the light levels to said light output controller, and wherein the light output controller controls the electric current fed to each of the plural kinds of said LEDs in the light emitting module so that the mixed-color light from the light emitting module has the same ratio of the light levels as that of the light levels output from the ambient light sensor.

18. The LED luminaire as set forth in any one of claims 13 to 17, further comprising:

a memory means for storing a reference value for each of the light levels for the specific colors that determines said desired chromaticity, wherein the light output controller controls the electric current fed to each of the plural kinds of LEDs based on the reference values stored in the memory means.

19. The LED luminaire as set forth in any one of claims 13 to 17, wherein the light sensor comprises:

a plurality of color filters configured to selectively pass the lights of the specific colors; and a plurality of level sensors configured to detect respective light levels for the specific colors of lights passing through a plurality of said color filters.

20. The LED luminaire as set forth in any one of claims 13 to 17, wherein the light sensor comprises:

a spectroscopic element for spectrally diffracting the mixed-color light into the lights of the specific colors; and a level sensor detecting a light level for each of the specific colors diffracted by said spectroscopic element.

21. The LED luminaire as set forth in any one of claims 13 to 17, further comprising:

a circuit board mounting thereon said at least one light emitting module and said light sensor; and a main body supporting the circuit board.

* * * * *